US010788192B2

(12) United States Patent
Rabolin et al.

(10) Patent No.: US 10,788,192 B2
(45) Date of Patent: Sep. 29, 2020

(54) HOUSING FOR MOUNTING A SURFACE LIGHTING ELEMENT

(71) Applicant: SAINT-GOBAIN PLACO, Suresnes (FR)

(72) Inventors: Sylvain Rabolin, Etrigny (FR); Philippe L'Huillier, Sassangy (FR); David Coudurier, Beaune (FR); Jean-Louis Diniel, Chatenoy le Royal (FR)

(73) Assignee: SAINT-GOBAIN PLACO, Suresnes (FR)

( * ) Notice: Subject to any disclaimer, the term of this patent is extended or adjusted under 35 U.S.C. 154(b) by 18 days.

(21) Appl. No.: 16/061,744

(22) PCT Filed: Dec. 16, 2016

(86) PCT No.: PCT/FR2016/053527
§ 371 (c)(1),
(2) Date: Jun. 13, 2018

(87) PCT Pub. No.: WO2017/103539
PCT Pub. Date: Jun. 22, 2017

(65) Prior Publication Data

US 2018/0363887 A1 Dec. 20, 2018

(30) Foreign Application Priority Data

Dec. 17, 2015 (FR) ..... 15 62588

(51) Int. Cl.
*F21V 15/00* (2015.01)
*F21V 17/00* (2006.01)
(Continued)

(52) U.S. Cl.
CPC ..... *F21V 21/04* (2013.01); *F21S 8/02* (2013.01); *F21S 8/022* (2013.01); *F21S 8/024* (2013.01);
(Continued)

(58) Field of Classification Search
CPC ..... F21S 8/02–068; F21V 17/00–20; F21V 19/00–06; F21V 21/00–35
(Continued)

(56) References Cited

U.S. PATENT DOCUMENTS 6,059,424 A * 5/2000 Kotloff ..... F21V 17/107 362/220
2013/0027915 A1 1/2013 Caferro et al.
(Continued)

FOREIGN PATENT DOCUMENTS

EP 2 194 313 A1 6/2010
FR 2 970 019 A1 7/2012
(Continued)

OTHER PUBLICATIONS

International Search Report dated Feb. 10, 2017 in PCT/FR2016/053527 filed Dec. 16, 2016.

*Primary Examiner* — Jason M Han
(74) *Attorney, Agent, or Firm* — Oblon, McCelland, Maier & Neustadt, L.L.P.

(57) ABSTRACT

A housing, which is provided for incorporating a surface lighting element in a wall, includes a base intended to be fixed in the wall and a flap for receiving the surface lighting element. The flap receives the surface lighting element on its face directed toward the outside of the housing and is mounted to pivot on the base by at least one removable link axis making it possible to dismantle and reassemble the flap relative to the base.

18 Claims, 3 Drawing Sheets

(51) Int. Cl.

| | |
|---|---|
| ***F21V 21/04*** | (2006.01) |
| ***F21V 17/10*** | (2006.01) |
| ***F21S 8/02*** | (2006.01) |
| ***F21V 19/04*** | (2006.01) |
| ***F21V 21/14*** | (2006.01) |
| *F21Y 115/15* | (2016.01) |
| *F21Y 105/00* | (2016.01) |

(52) U.S. Cl.
CPC ..... *F21S 8/026* (2013.01); *F21V 17/107* (2013.01); *F21V 19/04* (2013.01); *F21V 21/14* (2013.01); *F21Y 2105/00* (2013.01); *F21Y 2115/15* (2016.08)

(58) Field of Classification Search
USPC ..... 362/147–150, 217.1–217.17, 362–375, 362/401–404, 457–458
See application file for complete search history.

(56) References Cited

U.S. PATENT DOCUMENTS

| | | | | |
|---|---|---|---|---|
| 2013/0223100 | A1 | 8/2013 | Caferro et al. | |
| 2015/0184808 | A1* | 7/2015 | Wang ..... | F21V 23/009 362/235 |

FOREIGN PATENT DOCUMENTS

| | | | |
|---|---|---|---|
| FR | 2 974 132 | A1 | 10/2012 |
| JP | 2003-217334 | A | 7/2003 |

* cited by examiner

HOUSING FOR MOUNTING A SURFACE LIGHTING ELEMENT

The present invention deals with a housing for incorporating a surface lighting element in a wall, in particular an inside or outside wall, a partition, a ceiling, a floor. The invention also deals with a wall comprising such a housing, and a method for mounting a surface lighting element in a wall using such a housing.

In the context of the invention, a wall can be, in particular, a wall of a building or a wall of a vehicle. It can be a monolithic wall formed by a single layer of material, with no facing element, such as a concrete or brick wall. In a variant, it can be a composite wall comprising, on the one hand, a support structure and, on the other hand, facing elements which are assembled with the support structure and which form the surface of the wall.

Nonlimiting examples of composite walls that can be cited include: an internal or external wall of a building comprising sheets of plaster or of wood as facing elements, which are added to a brick or concrete wall acting as support structure; a partition comprising sheets of plaster or other panels as facing elements, which are positioned in a partition framework made up of bottom and top wall plates and uprights acting as support structure; a ceiling comprising ceiling tiles as facing elements, for example of mineral wool, which are suspended on a ceiling structure or positioned in a ceiling framework acting as support structures; a floor comprising, as facing elements, floor tiles, for example made of natural or laminated wood, which are added to an underlying floor structure acting as support structure.

It is known practice to produce lighting fittings from organic light-emitting diodes (OLED), which are able to convert electrical energy into a radiation. An OLED comprises a stack of light-emitting organic layers inserted between two electrically conductive contacts forming front and back electrodes. An OLED is conventionally encapsulated between two protection substrates, front and back, so as to form an OLED lighting element. At least the front electrode and the front protection substrate are transparent, in order to allow the radiation emitted by the stack of light-emitting layers to exit through the front face of the OLED element. The front and back protection substrates can in particular consist of glass or of a rigid or flexible organic polymer material.

An OLED lighting element has the advantages of being particularly thin, in particular with a thickness of the order of 2 mm, and of emitting a diffuse radiation, which makes it possible to obtain a uniform surface lighting. In comparison, a lighting element of inorganic LED type is a light source with a highly directed beam, which dictates the use of an optical diffuser if a surface lighting is desired, and generally has a greater thickness than an OLED lighting element. When the OLED is encapsulated with flexible polymer substrates rather than rigid substrates, the OLED lighting element also has the advantages of being flexible, foldable and lightweight.

DE 10 2009 025 424 A1 describes the incorporation of OLED lighting elements in a wall, by embedding each OLED lighting element in a recess formed in the wall. In one embodiment, each OLED lighting element is fixed, in particular by screwing, onto a front face of a support structure of the wall. Facing sheets of the wall are then fixed on the front of the support structure, by being arranged around the OLED lighting element, such that the latter is received in a recess delimited between the facing sheets. The elements for the electrical connection of the OLED lighting element are housed between the front face of the support structure and the facing sheets. In this embodiment, the OLED lighting element is flush with the surface of the wall formed by the front faces of the facing sheets, which makes it possible to obtain a good visual appearance of the wall incorporating the lighting element.

However, in this embodiment, with each OLED lighting element being fixed, in particular by screwing, to the support structure at the back of the recess defined by the facing sheets, it is difficult to dismantle the OLED lighting element relative to the wall. Now, the dismantling of the OLED lighting element may be necessary for maintenance purposes or to replace the lighting element in case of failure. Nor it is easy to reassemble the lighting element in the recess, and the dismantling and reassembly operations are likely to damage brittle parts of the lighting element, such as the light-emission elements or the electrical device.

It is these drawbacks that the invention aims more particularly to remedy by proposing a housing allowing for easy mounting and dismantling of a surface lighting element, in particular OLED, in a wall, while limiting the risks of damage to the surface lighting element, such that the maintenance or the replacement of the surface lighting element can be performed easily, this housing further guaranteeing a good visual appearance of the surface of the wall provided with the surface lighting element.

To this end, the subject of the invention is a housing for incorporating a surface lighting element in a wall, comprising a base intended to be fixed in the wall and a flap for receiving the surface lighting element, characterized in that the flap is configured to receive the surface lighting element on its face directed toward the outside of the housing, the flap being mounted to pivot on the base by means of at least one removable link axis making it possible to dismantle and reassemble the flap relative to the base.

According to the invention, the link axis is removable relative to at least one out of the base and the flap. This removable axis allows for easy dismantling and reassembly of the flap relative to the base.

For the incorporation of a surface lighting element in a wall using a housing according to the invention, it is possible to separate the flap from the base of the housing such that the base can be fixed alone in the wall, independently of the flap and of the surface lighting element, which avoids any risk of damage to the surface lighting element in this fixing step. Once the base has been fixed in the wall and any finishing operations have been carried out to best incorporate the base in the surface of the wall, the flap provided with the surface lighting element can easily be assembled with the base by means of the link axis. The surface lighting element can then be positioned to be flush with the surface of the wall, in particular by pivoting of the flap which bears it relative to the base about the link axis, from an open position allowing the flap to be fixed to the base by means of the link axis, to a closed position where the flap is substantially parallel to a median plane of the base and blocks the access to the link axis.

When a surface lighting element has been mounted in a wall using a housing according to the invention, the flap bearing the surface lighting element can easily be dismantled then reassembled relative to the base, and therefore relative to the wall, as many times as necessary, for example for maintenance operations on the electrical power supply device or for the replacement of the surface lighting element. By virtue of the mounting with a removable link axis, the repeated steps of dismantling and reassembly of the flap relative to the base are done without damage to the link between the flap and the base, which would not be the case for example with deformable link means such as clips made of plastic material which are not designed to withstand repeated stresses over time.

Advantageously, the dismantling and the reassembly of the flap bearing the surface lighting element relative to the base can be accomplished by an end user without specific qualification, and they do not require any tools. For the dismantling, the flap is once again pivoted relative to the base about the link axis, but this time from the closed position to the open position when the flap frees access to the removable link axis, which makes it possible to separate the flap relative to the base by removing the link axis. An end user can thus easily have access to the back of the surface lighting element. The dismantling also makes it possible to set the flap provided with the surface lighting element to one side or to reserve it, for example in order to paint the wall without the risk of damaging the surface lighting element.

According to one aspect of the invention, the base and the flap are linked by an intermediate piece articulated at a first end on the base, by means of a first link axis, and at a second end on the flap, by means of a second link axis, at least one out of the first link axis and the second link axis being a removable axis making it possible to dismantle and reassemble the flap relative to the base.

The intermediate piece articulated both relative to the base and relative to the flap, which acts as a link rod, allows the surface lighting element mounted on the flap to be housed in the wall with a lateral gap which is as small as possible relative to the surrounding elements, which can be facing elements of the wall or other lighting elements in the case of a paving arrangement to obtain a light surface of large size. It is thus possible to conceal the structure of the housing and obtain an aesthetic incorporation of the surface lighting element in the surface of the wall, where only the emitting face of the surface lighting element is visible.

According to one aspect of the invention, the link axis between the flap and the intermediate piece is a removable axis relative to at least one out of the flap and the intermediate piece.

In one embodiment, the housing is able to be housed in the thickness of a facing element of the wall. Preferably, in a closed position of the flap where it is substantially parallel to a median plane of the base, the housing provided with the surface lighting element has a thickness less than or equal to that of the facing elements of the wall, taken transversely to the surface of the wall.

For a composite wall comprising a support structure and facing elements which are assembled with the support structure, the base of the housing can be configured to be fixed on at least one structural element of the wall and/or on at least one facing element of the wall.

Advantageously, in the installed configuration of the housing in a wall, with the base fixed in the wall and the flap mounted on the base, the flap is able to receive the surface lighting element such that, in a closed position of the flap where it is substantially parallel to a median plane of the base, the surface lighting element is flush with the surface of the wall. That makes it possible to obtain a uniform visual appearance of the surface of the wall.

According to the invention, the surface lighting element can in particular be an OLED element, rigid or flexible. In a variant, the surface lighting element can be formed by at least one non-surface source, such as a light-emitting diode (LED), associated with an optical diffuser. It can in particular be a diffusing plate lit by the edge using light-emitting diodes (LED).

According to an aspect of the invention, the flap is able to pivot relative to the base between a closed position in which the flap is substantially parallel to a median plane of the base, and an open position in which the flap frees access to the removable link axis.

Advantageously, the or each link axis between the flap and the base is housed in an internal volume of the housing defined between the base and the flap in the closed position of the flap. In particular, when the flap is mounted to pivot on the base using an intermediate piece articulated both relative to the base and relative to the flap, the two link axes are advantageously housed in a volume defined between the base and the flap in the closed position of the flap. Thus, the housing is compact and secured, the link axes not being accessible in the closed position of the flap. Furthermore, the link axes are not visible, which contributes to a good visual appearance of a wall incorporating a surface lighting element mounted on the flap.

When the flap is mounted to pivot on the base using an intermediate piece articulated both relative to the base and relative to the flap, the flap is able to be displaced relative to the base between a closed position in which the flap and the intermediate piece are substantially parallel to a median plane of the base, and an open position in which at least the intermediate piece is inclined relative to the median plane of the base and the flap frees access to the removable link axis.

Advantageously, the base and the flap comprise complementary elements for guiding the flap relative to the base between the open position and the closed position. These guiding elements make it possible to ensure an accurate positioning of the flap relative to the base and to compensate for any plays or positioning differences linked to the presence of the removal link axis or axes of the housing. Preferably, the guiding elements ensure a centering of the flap relative to the base.

According to an aspect of the invention, the housing comprises elements for locking the flap relative to the base in a closed position of the flap where it is substantially parallel to a median plane of the base. Advantageously, the locking elements comprise a member for holding the flap in the closed position, in particular an elastic member of spring-blade type, which is able to be deactivated by the application of a pushing force from the outside of the housing.

According to an advantageous feature, the base of the housing comprises a bottom provided with at least one orifice intended for the passage of electrical connection elements of the surface lighting element. It is thus possible to connect the surface lighting element to a current source or to a low-voltage network situated behind the housing. In particular, in the case of a composite wall, elements for connecting to a current source or a low-voltage network can be provided in the volume of the support structure, behind the facing elements.

According to an aspect of the invention, the base comprises peripheral flanges protruding relative to a bottom of the base and the housing comprises clamps configured to top the flanges of the base. In an advantageous embodiment, each clamp is able to top both the flanges of a first housing and of a second housing that are juxtaposed, so as to ensure a link between housings. Such a link between housings is advantageous in particular in the case of a paving of surface lighting elements to obtain a light surface of large size.

Another subject of the invention is a wall, such as an inside or outside wall, a partition, a ceiling, a floor, comprising at least one housing as described above.

According to an aspect of the invention, the wall comprises several housings as described above and electrical connection elements ensuring an electrical connection between the housings. These electrical connection elements are advantageously linked to a current source or to a low-voltage network behind the housings.

Another subject of the invention is a method for mounting a surface lighting element in a wall using a housing as described above, comprising steps in which:

the base is fixed in the wall;

the surface lighting element is fixed on the face of the flap intended to be directed toward the outside of the housing;

the flap is mounted on the base using the removable link axis.

The preceding steps can be performed in any order. However, preferably, the base is fixed in the wall while the flap is separated from the base and, once the base is fixed in the wall, the flap is mounted on the base using the removable link axis.

The features and advantages of the invention will become apparent in the following description of two embodiments of a housing according to the invention, given purely by way of example and with reference to the attached drawings in which.

Figure 1:
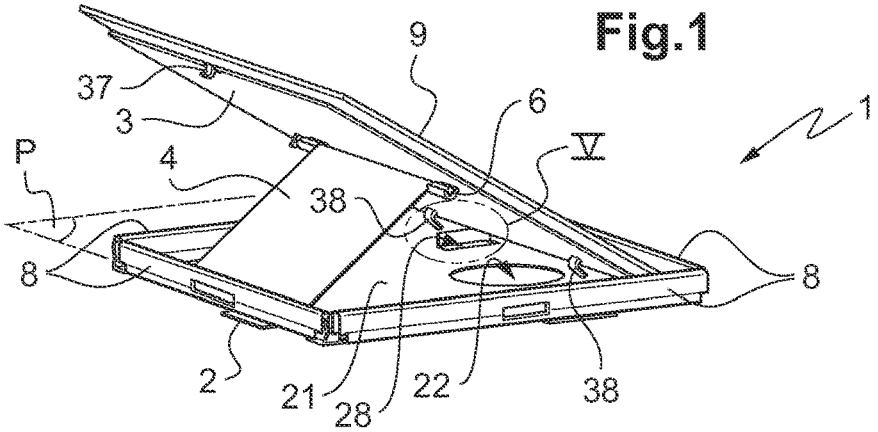
FIG. 1 is a perspective view of a housing according to a first embodiment of the invention in which the flap, provided with an OLED lighting element, is in the open position.
Figure 2:
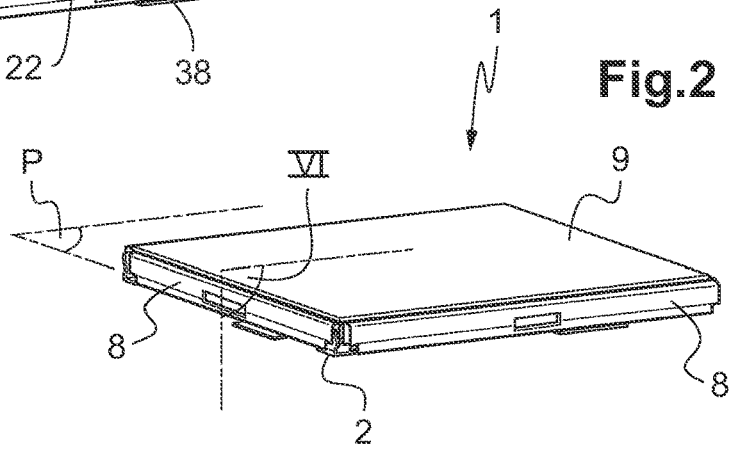
FIG. 2 is a view similar to FIG. 1 with the flap in the closed position.

In the first embodiment represented in FIGS. 1 to 8, the housing 1 is intended for the incorporation of a surface lighting element 9, in particular an OLED element, in a wall such as an inside or outside wall, a partition, a ceiling, a floor. The housing 1 comprises a base 2 and flap 3 linked to one another by a link rod 4. The base 2 is intended to be fixed in the wall and the flap 3 is able to receive the lighting element 9 on its face 3A directed toward the outside of the housing. The lighting element 9 can be assembled with the flap 3 by any appropriate means, for example by gluing.

The link rod 4 is articulated at a first end 42 on the base 2 and at an opposite second end 43 on the flap 3. Thus, the flap 3 is mounted to pivot on the base 2 via the link rod 4. The flap 3 is able to be displaced relative to the base 2 between a closed position, visible in FIG. 2, in which the flap 3 and the link rod 4 are substantially parallel to a median plane P of the base 2, and an open position, an example of which is visible in FIG. 1, in which at least the link rod is inclined relative to the median plane P of the base 2 and the flap 3 frees access to the internal volume of the housing.

The choice of a pivoting mounting of the flap 3 on the base 2 via a link rod 4 with two link axes 5 and 6 parallel to one another, rather than a pivoting mounting of the flap 3 directly on the base 2 with a single link axis makes it possible to obtain a combined rotational and translational movement of the flap 3 relative to the base 2. It is thus possible to dimension the lighting element 9 mounted on the flap 3 such that it comes to be housed flush with the surface of a wall with a lateral spacing that is as small as possible relative to the surrounding elements, which guarantees a good visual appearance of the surface of the wall, without in any way hampering the passage of the flap 3 provided with the lighting element 9 between the closed position and the open position when the housing 1 is installed in the wall.

The link axis 5 between the first end 42 of the link rod 4 and the base 2 is a fixed axis, whereas the link axis 6 between the second end 43 of the link rod 4 and the flap 3 is a removable axis. In this embodiment, the link axis 6 is removable both relative to the flap 3 and to the link rod 4, it being understood that it could be removable only relative to one of these two pieces. In the open position, as shown in FIG. 1, the flap 3 frees access to the removable link axis 6, which allows for a dismantling of the flap 3 relative to the base 2 by the removal of the removable link axis 6 with respect to the flap 3 and/or the link rod 4.

The base 2 of the housing 1 is able to be fixed in a wall by any known means, in particular by screwing. Preferably, prior to the fixing of the base 2 in a wall, the flap 3 is separated from the base 2, in particular when it is already provided with the lighting element 9, which makes it possible to avoid any damage to the lighting element 9 in this fixing step.

Figure 4:
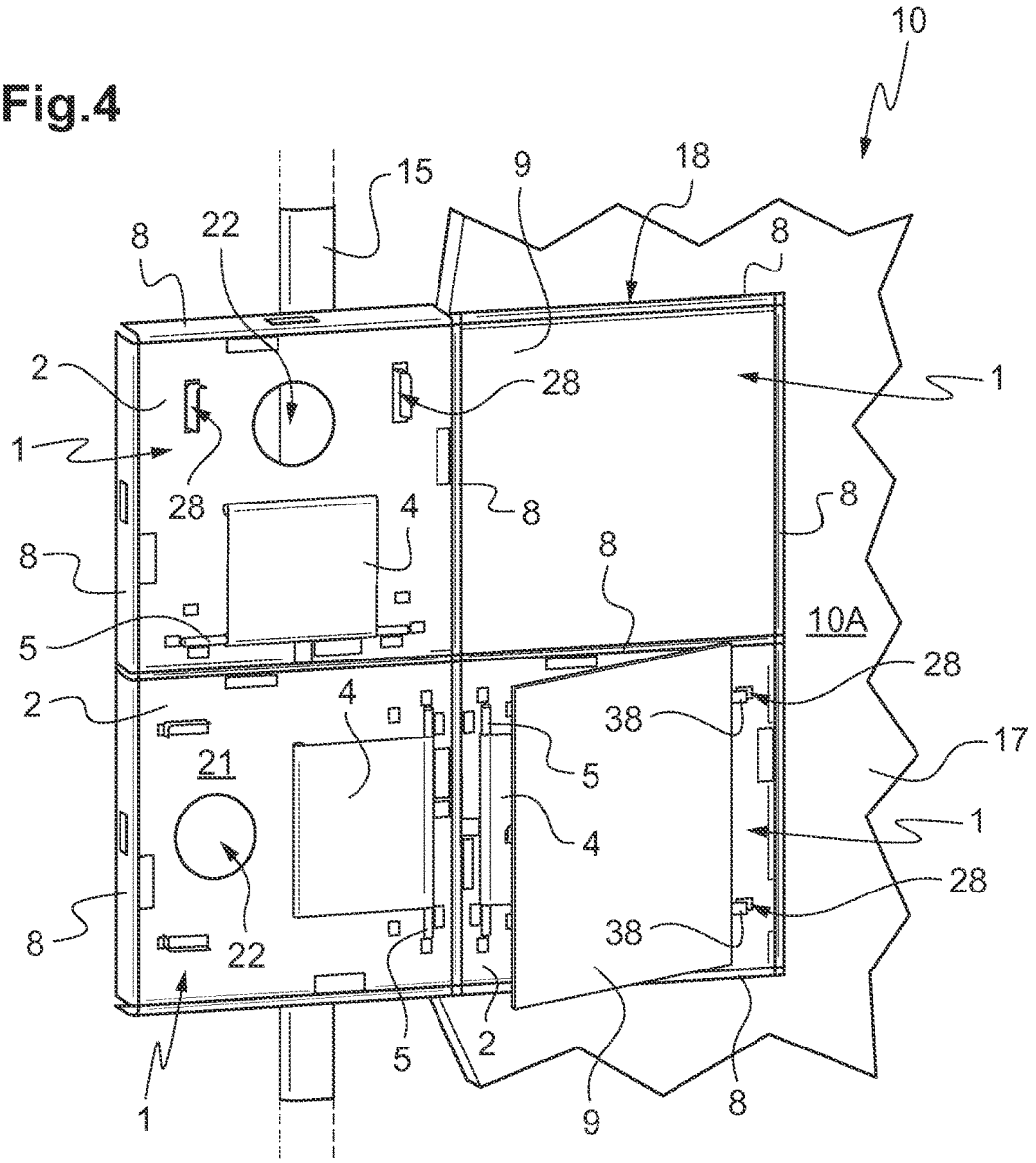
FIG. 4 is a partial front view of a partition comprising four housings identical to that of FIG. 1 for the incorporation of OLED lighting elements in the partition.
Figure 5:
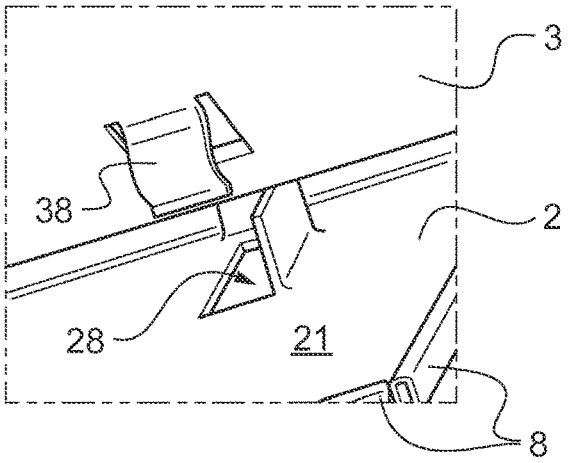
FIG. 5 is a larger scale perspective view of the detail V of FIG. 1.

In the case of a composite wall, the base 2 can be fixed onto at least one structural element and/or onto at least one facing element of the wall. In the example of FIG. 4, the base of each of the four identical housings 1 is fixed by screwing onto an upright 15 of the partition 10. In this example, the partition 10 comprises sheets of plaster 17 as facing elements, for example sheets of plaster of BA13 type, which are positioned in a partition framework made up of top and bottom wall plates (not represented) and uprights 15 as structural elements.

The four housings 1 are positioned in an opening 18, which can be formed between several facing sheets 17 or cut from at least one facing sheet 17. The electrical power supply of the lighting elements 9 borne by the four housings 1 is ensured by any means known to those skilled in the art. In particular, the partition 10 can comprise elements ensuring an electrical connection between the four housings 1, which can be linked to a current source or to a low-voltage network provided behind the housings in the framework of the partition. The electrical power supply can be controlled independently for each lighting element 9 or globally for the four elements 9, via one or more switches. Thus, the partition 10 has a dual function of partition and of luminaire.

Advantageously, the housing 1 is able to be housed in the thickness of the facing sheets 17 of the partition 10. In the installed configuration of each housing 1 in the partition 10, with the base 2 which is fixed onto an upright 15 and the flap 3 provided with the lighting element 9 which is mounted to pivot on the base 2 via the link rod 4, the flap 3 is able to pass between the closed position illustrated by the housing 1 top right in FIG. 4, and the open position illustrated by the housing 1 bottom right in FIG. 4.

In the closed position, the lighting element 9 is flush with the surface 10A of the partition 10, which makes it possible to obtain a uniform visual appearance of this surface 10A. In the open position, it is possible to dismantle the flap 3 provided with the lighting element 9 relative to the base 2 and to have access to the back of the partition 10, for example for maintenance operations.

In this embodiment, the base 2, the flap 3 and the link rod 4 of the housing 1 are each produced by folding and cutting a plate. Preferably, the base 2, the flap 3 and the link rod 4 of the housing 1 are produced in galvanized steel.

In a variant, one or more elements out of the base 2, the flap 3 and the link rod 4 of the housing 1 can be produced from other materials suited to their function, in particular from a polymer material, such as, for example, acrylonitrile butadiene styrene (ABS), the polymer material being possibly reinforced by fibers such as glass or carbon fibers. The various elements of the housing 1 can then advantageously be obtained by injection molding.

The base 2 of the housing 1 comprises a bottom 21 of quadrilateral form and a plurality of peripheral flanges 23, which are all protruding from the same side relative to the bottom 21. In the closed position, the flap 3 and the link rod 4 are facing the bottom 21 of the base 2 and are surrounded by the flanges 23. In order to ensure a uniform visual appearance of the periphery of the base 2, the housing 1 comprises four clamps 8 configured to be snap-fitted onto the flanges on each of the four sides of the base. Advantageously, each clamp 8 is able to top both the flanges 23 of one side of a first housing 1 and the flanges 23 of an adjacent side of a second housing 1, as shown in the larger scale view of FIG. 7. It is thus possible to obtain a link between housings in the case of a paving with several housings 1 juxtaposed to obtain a light surface of large size, as illustrated in the example of FIG. 4.

Figure 3:
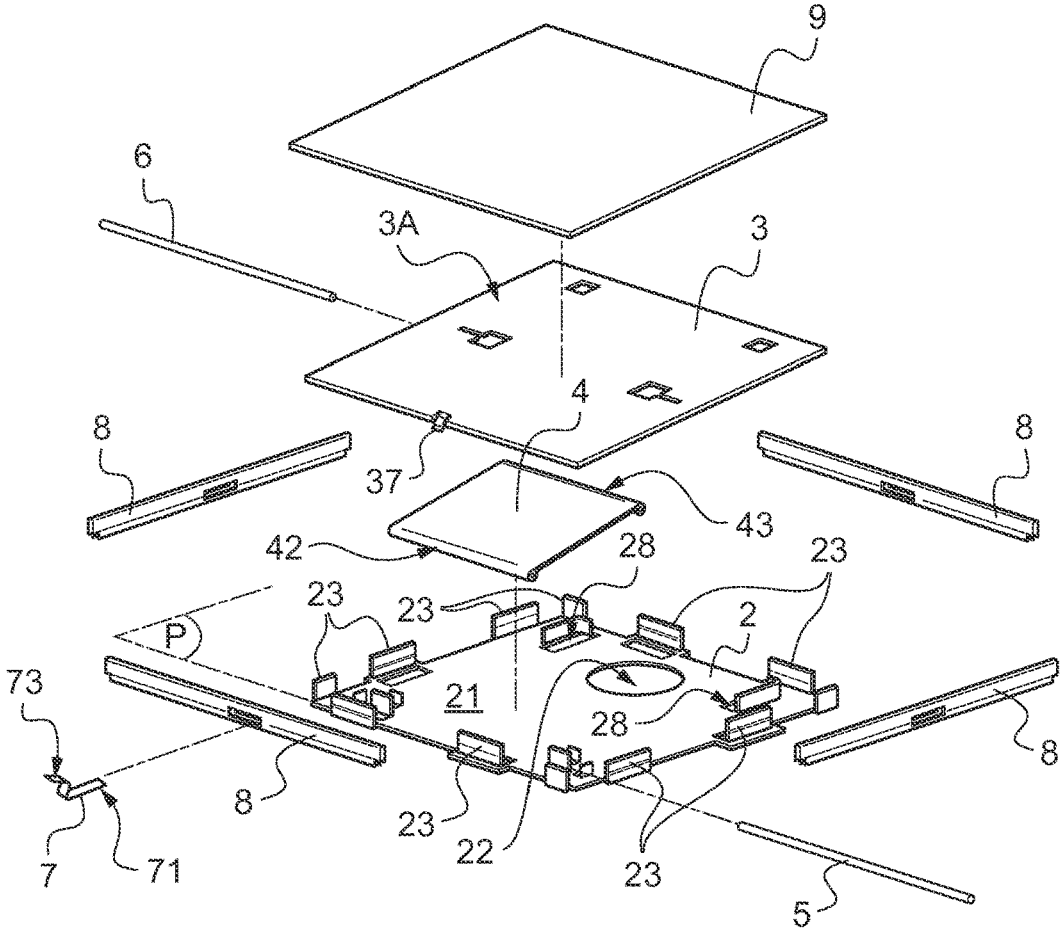
FIG. 3 is an exploded perspective view of the housing of FIG. 1.
Figure 8:
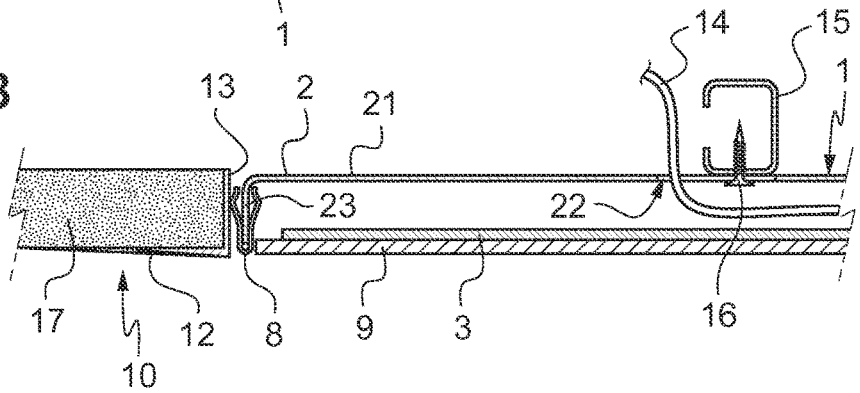
FIG. 8 is a transverse cross section along the line VIII-VIII of FIG. 4 in the closed position of the flap provided with an OLED lighting element.

As can clearly be seen in FIG. 3, the bottom 21 of the base 2 is provided with several cutouts. In particular, the bottom 21 comprises an orifice 22 provided for the passage of electrical connection cables 14 of the lighting element 9, as shown in FIG. 8, in order to connect the element 9 to a current source or to a low-voltage network situated behind the housing 1. The bottom 21 is also provided with two grooves 28 intended to guide the displacement of the flap 3 relative to the base 2 between the open position and the closed position, which are suitable for cooperating with complementary hooks 38 provided on the flap 3. The grooves 28 and hooks 38, of which one pair is clearly visible in FIG. 5, make it possible to ensure an accurate positioning and a centering of the flap 3 relative to the base 2 in the passage between the open position and the closed position, and compensating for any positioning plays due to the link axes, and in particular to the removable link axis 6.

The grooves 28 and hooks 38 also allow for a locking of the flap 3 relative to the base 2 in the closed position, in combination with an additional hook 37 of the flap 3 and a spring blade 7. The spring blade 7, which is overall in the form of a S, can be made of steel or any other material suited to its function. An end part 71 of the S is fixed to the bottom 21 of the base 2, passing between the bottom 21 and the end 42 of the link rod 4 at the link axis 5, whereas the other end part 73 of the S is intended to be received in a notch 83 of the clamp 8 which tops the side of the base 2 situated in the vicinity of the link axis 5.

Figure 6:
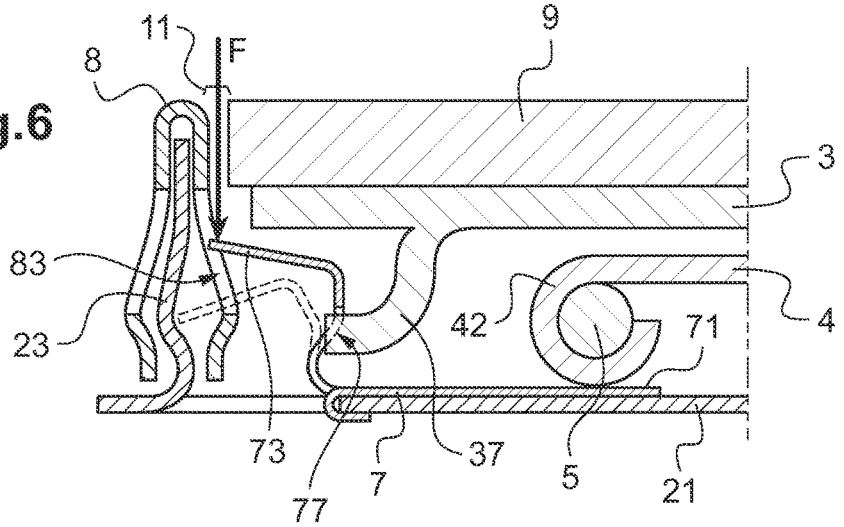
FIG. 6 is a larger scale partial cross section on the plane VI of FIG. 2.
Figure 7:
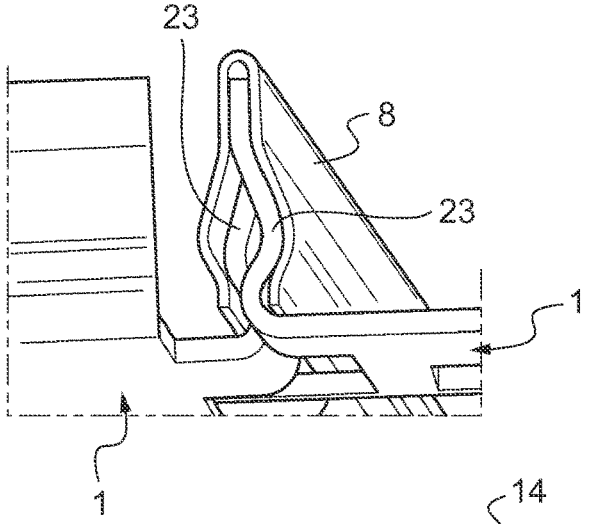
FIG. 7 is a larger scale perspective view of two adjacent housings of FIG. 4.

As shown in FIG. 6, the spring blade 7 comprises, in the central part of the S, an opening 77 provided to receive the hook 37 of the flap 3 in the closed position, and thus elastically hold the flap 3 in the closed position against an opening force. To pass from the closed position to the open position, the action of the spring blade 7 on the hook 37 is able to be deactivated by the application of a pushing force F, from the outside of the housing 1, on the end part 73 of the spring blade 7. This force F can for example be exerted using a rigid card that is slipped into the interstice 11 delimited between the clamp 8 cooperating with the end part 73 of the spring blade 7 and the edge facing the lighting element 9. The pushing force F provokes a deformation of the spring blade 7, as shown by dotted lines in FIG. 6, such that the hook 37 of the flap is no longer engaged in the opening 77 of the spring blade 7, which frees the flap and allows it to pass from the closed position to the open position.

The mounting of a lighting element 9 in the partition using a housing 1 according to the invention comprises a step in which the base 2 of the housing 1 is rigidly fixed in the partition 10, in particular by screwing the bottom 21 onto an upright 15 of the partition using at least one screw 16, as shown in FIG. 8. Preferably, this step takes place while the flap 3 is separated from the base 2. Moreover, in another step, the lighting element 9 is fixed onto the flap 3, for example by gluing. Here again, preferably, this step takes place while the flap 3 is separated from the base 2.

The flap 3 provided with the lighting element 9 is then mounted on the base 2 fixed in the partition 10 using the removable link axis 6, the flap 3 being in the open position. The flap 3 bearing the lighting element 9 is then passed from the open position to the closed position by displacement of the link rod 4 and of the flap 3 about the link axes 5 and 6. In the closed position, the lighting element 9 is flush with the surface 10A of the partition 10.

In order to ensure an optimal aesthetic appearance of the partition 10, the partition 10 advantageously comprises finishing joints 12 at each join between a clamp 8 of a housing 1 and an adjacent facing sheet 17. Advantageously, these finishing joints can be produced by using profile sections 13 of Placolistel® type marketed by the company Placoplatre, which are inserted at each join between a clamp 8 and an adjacent facing sheet 17, screw fixed into the facing sheet 17, then covered with a finishing coating. Preferably, the flap provided with the lighting element 9 is removed during the finishing works involving the fitting of finishing joints, or even painting, which makes it possible to avoid any damage to the lighting element 9.

Figure 9:
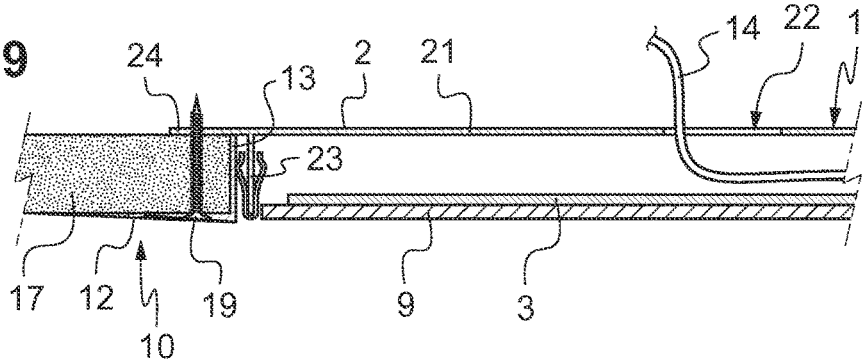
FIG. 9 is a cross section similar to FIG. 8 for a housing according to a second embodiment of the invention.

In the second embodiment represented in FIG. 9, the elements similar to those of the first embodiment bear identical references. The housing 1 of this second embodiment differs from that of the first embodiment only in that the base 2 of the housing is adapted to allow it to be fixed onto a facing element 17 of the partition 10. To this end, the bottom 21 of the base 2 is extended, beyond the protruding flanges 23, by a rim 24 suitable for coming to bear behind the facing sheet or sheets 17 of the partition 10 which surround the housing 1. The base 2 can then be fixed onto at least one of these facing sheets 17, for example by screwing using a screw 19 which passes both through the finishing profile section 13, the facing sheet 17 and the rim 24 of the base 2.

As emerges from the preceding embodiments, the incorporation of a surface lighting element in a wall using a housing according to the invention is performed particularly easily, with no risk of damage to the surface lighting element since, by virtue of the removable link axis, it is possible to separate the flap provided with the surface lighting element from the base of the housing to fix the base on its own in the wall. Very advantageously, a housing according to the invention can easily be incorporated in a conventional composite wall structure, such as a partition, a ceiling, a floor, which makes it possible to form a wall ensuring a dual function of wall and of luminaire.

In the installed configuration in a wall, a housing according to the invention also allows for easy mounting and dismantling of the flap bearing the surface lighting element relative to the base and therefore relative to the wall, without requiring tools and as many times as necessary. An end user can thus easily carry out operations of maintenance or of replacement of the surface lighting element.

Furthermore, with an integration housing according to the invention, it is possible to create, on a wall, a light surface with a good visual appearance, including at the join between each surface lighting element and an adjacent facing sheet where finishing joints are advantageously produced. The light surface obtained can also be of large size, by paving using several juxtaposed housings.

The invention is not limited to the embodiments described and represented.

In particular, in the above examples, the flap of the integration housing is mounted to pivot on the base using an intermediate piece articulated both on the base and on the flap with two link axes. In a variant, the flap can be mounted to pivot directly on the base with just one link axis, with no intermediate piece.

Furthermore, when the base and the flap are linked by an intermediate piece articulated at a first end on the base, by means of a first link axis, and at a second end on the flap, by means of a second link axis, it is possible to provide for each of the two link axes to be a removable axis, and not just one of the two axes as in the preceding examples, or even for it to be the link axis between the intermediate piece and the base which is a removable axis, instead of the link axis between the intermediate piece and the flap as in the preceding examples.

The surface lighting element borne by the flap of an integration housing according to the invention can also be different from an OLED element. As an example, the surface lighting element can be a diffusing plate, flexible or rigid, lit by the edge using light-emitting diodes (LED).

Finally, the invention has been illustrated in the case of a partition with dismantleable framework and plaster facings. The invention is however also applicable to other types of walls, in particular both to monolithic walls and composite walls, in particular to partitions, ceilings, floors.

The invention claimed is:

1. A housing for incorporating a surface lighting element in a wall, comprising:

a base configured to be fixed in the wall; and a flap for receiving the surface lighting element, wherein the flap is configured to receive the surface lighting element on a face of the flap directed toward an outside of the housing, wherein the flap is mounted to pivot on the base via at least one removable link axis so as to dismantle and reassemble the flap relative to the base, and wherein the base and the flap are linked by an intermediate piece configured to pivot at a first end on the base, via a first link axis, and configured to pivot at a second end on the flap, via a second link axis.

2. The housing as claimed in claim 1, wherein at least one out of the first link axis and the second link axis is a removable axis so as to dismantle and reassemble the flap relative to the base.

3. The housing as claimed in claim 2, wherein the link axis between the flap and the intermediate piece is a removable axis relative to at least one out of the flap and the intermediate piece.

4. The housing as claimed in claim 1, wherein, in a closed position of the flap where the flap is substantially parallel to a median plane of the base, the housing provided with the surface lighting element has a thickness less than or equal to a thickness of facing elements of the wall.

5. The housing as claimed in claim 1, wherein, in an installed configuration of the housing in the wall, with the base fixed in the wall and the flap mounted on the base, the flap is able to receive the surface lighting element such that, in a closed position of the flap where the flap is substantially parallel to a median plane of the base, the surface lighting element is flush with a surface of the wall.

6. The housing as claimed in claim 1, wherein the flap is configured to receive an OLED element.

7. The housing as claimed in claim 1, wherein the flap is able to pivot relative to the base between a closed position in which the flap is substantially parallel to a median plane of the base, and an open position in which the flap frees access to the removable link axis.

8. The housing as claimed in claim 7, wherein the base and the flap comprise complementary elements for guiding the flap relative to the base between an open position and a closed position.

9. The housing as claimed in claim 1, further comprising elements for locking the flap relative to the base in a closed position of the flap where the flap is substantially parallel to a median plane of the base.

10. The housing as claimed in claim 9, wherein the locking elements include a member for bolding the flap in the closed position, which is able to be deactivated by the application of a pushing force from the outside of the housing.

11. The housing as claimed in claim 1, wherein the base includes a bottom provided with at least one orifice intended for the passage of electrical connection elements of the surface lighting element.

12. The housing as claimed in claim 1, wherein the base includes peripheral flanges protruding relative to a bottom of the base, the housing including clamps configured to top the flanges of the base.

13. The housing as claimed in claim 12, wherein each of the clamps is able to top both the flanges of a first housing and the flanges of a second housing that are juxtaposed.

14. The housing as claimed in claim 1, wherein the base is configured to be fixed to at least one structural element of the wall.

15. The housing as claimed in claim 1, wherein the base is configured to be fixed to at least one facing element of the wall.

16. A wall, comprising:

at least one housing as claimed in claim 1.

17. The wall as claimed in claim 16, wherein the wall is an inside or outside wall, a partition, a ceiling, or a floor.

18. A method for mounting a surface lighting element in a wall using a housing as claimed in claim 1, the method comprising:

fixing the base in the wall;

fixing the surface lighting element on the face of the flap intended to be directed toward the outside of the housing; and mounting the flap on the base using the removable link axis.

* * * * *